US005573060A

United States Patent [19]

Adderley et al.

[11] Patent Number: 5,573,060

[45] **Date of Patent: *Nov. 12, 1996**

[54] HEAT EXCHANGER

[75] Inventors: Colin I. Adderley, Derby; John O. Fowler, Lancashire; Michael F. Wignall, Derbyshire, all of England

[73] Assignees: Rolls-Royce And Associates Limited, Derby; Rolls-Royce plc, London, both of England

[ * ] Notice: The term of this patent shall not extend beyond the expiration date of Pat. No. 5,465,785.

[21] Appl. No.: 421,911

[22] Filed: Apr. 14, 1995

Related U.S. Application Data

[63] Continuation of Ser. No. 107,781, Aug. 23, 1993, Pat. No. 5,465,785.

[30] Foreign Application Priority Data

Feb. 27, 1991 [GB] United Kingdom ..... 9104156

[51] Int. Cl.[6] ..... F28F 3/14

[52] U.S. Cl. ..... 165/166; 165/170; 165/DIG. 388; 165/DIG. 433

[58] Field of Search ..... 165/166, 170; 29/890.042

[56] References Cited

U.S. PATENT DOCUMENTS

| | | | |
|---|---|---|---|
| 1,831,533 | 11/1931 | Hubbard | 165/166 |
| 2,296,570 | 9/1942 | Peterson | 165/83 |
| 2,526,157 | 10/1950 | Ramen | 165/82 |
| 2,766,514 | 10/1956 | Adams | 228/118 |
| 2,877,000 | 3/1959 | Person | 165/159 |
| 3,239,922 | 3/1966 | Hansson | 29/890.03 |
| 3,297,082 | 1/1967 | Tranel et al. | 165/170 |
| 3,924,441 | 12/1975 | Kun | 72/475 |
| 3,927,817 | 12/1975 | Hamilton et al. | 228/157 |
| 4,484,623 | 11/1984 | Rowe et al. | 165/164 |
| 4,503,905 | 3/1985 | Newman et al. | 165/76 |
| 4,557,321 | 12/1985 | Von Resch | 165/122 |
| 4,805,695 | 2/1989 | Ishikawa et al. | 165/166 |
| 4,820,355 | 4/1989 | Bampton | 148/535 |
| 5,070,607 | 12/1991 | Boardman et al. | 29/890.042 |
| 5,072,790 | 12/1991 | Lapowsky | 165/166 |
| 5,465,785 | 11/1995 | Adderly et al. | 165/166 |

FOREIGN PATENT DOCUMENTS

| | | |
|---|---|---|
| 1495655 | 12/1977 | European Pat. Off. . |
| 1541241 | 2/1979 | European Pat. Off. . |
| 2218794 | 11/1989 | European Pat. Off. . |
| 0414435 | 2/1991 | European Pat. Off. . |
| 0460872 | 12/1991 | European Pat. Off. . |
| 2617583 | 1/1989 | France . |
| 3924581 | 1/1991 | Germany . |
| 2067532 | 7/1981 | United Kingdom . |
| 2124520 | 2/1984 | United Kingdom . |
| 2162302 | 1/1986 | United Kingdom . |
| 2235040 | 2/1991 | United Kingdom . |

*Primary Examiner*—Leonard R. Leo
*Attorney, Agent, or Firm*—Cushman Darby & Cushman, L.L.P.

[57] ABSTRACT

A plate-fin type of heat exchanger (400) facilitates exchange of heat between two process streams (S1, S2) e.g. high pressure methane and seawater. It comprises a matrix (M) of heat exchange plate elements (200') arranged side-by-side, flow passages (401) for the seawater process stream (S2) being defined between adjacent plate elements. The plate elements (200') are a high-integrity diffusion bonded sandwich construction comprising two outer sheets (101, 103—FIG. 3) and a superplastically expanded core sheet structure (102—FIG. 3) between the two outer sheets. The sandwich construction provides flow passages (117') for the methane process stream. Adjacent plate elements (200') are held in position relative to each other by serrated racks (403) which engage the edges of the plate elements.

4 Claims, 4 Drawing Sheets

HEAT EXCHANGER

This is a continuation of Application Ser. No. 08/107,781, filed Aug. 23, 1993, now U.S. Pat. No. 5,465,785.

FIELD OF THE INVENTION

This invention relates to heat exchangers of the kind generally known as plate-fin heat exchangers, though they also have some similarities to the shell-tube type.

BACKGROUND OF THE INVENTION

The fluid passages in plate-fin heat exchangers are defined by partitions of a metal which has a satisfactorily high coefficient of heat transfer, so that when a high temperature fluid is passed through some passages and low temperature fluid is passed through further passages which are adjacent thereto, there results a cooling of the originally high temperature fluid, by heat conduction through the thickness of the partitions into the cool fluid. Efficiency of heat exchange is boosted by inclusion in the fluid flow passages of so-called "fins", which may in fact be corrugated members, dimples, grooves, protuberances, baffles or other turbulence promoters, instead of fins as such.

Plate-fin heat exchangers offer significant advantages over shell-tube heat exchangers in terms of weight, space, thermal efficiency and the ability to handle several process streams—i.e. several streams of heat exchange media—at once. However, most current plate-fin heat exchanger technology is centred on a brazed matrix construction using aluminium components and is therefore limited to low pressure and low temperature operation. Even using other materials, such as stainless steel, operational pressure limits (say, 80–90 bar) apply because of brazing as the method of fabrication.

Our prior patent applications EP90308923.3 and GB9012618.6 disclose alternative ways of manufacturing plate-fin heat exchanger elements which help to avoid the above problems and allow greater flexibility in their design. Among other things, they describe a method of manufacturing heat exchange plate elements in which metal (e.g. titanium or stainless steel) sheets are stacked together and selectively diffusion bonded to each other before being superplastically deformed to a final hollow shape defining internal passages, which can incorporate integrally formed "fins". Use of superplastic deformation in the manufacturing process enables the generation of high volume fractions of hollowness in a heat exchanger element. The result is a high integrity, low weight heat exchanger element. For example, use of titanium alloy materials to produce heat exchanger elements by the diffusion bonding and superplastic forming route enables their operation at pressures in excess of 200 bar and at temperatures up to 300° C., whereas stainless steel materials enable even better performance.

SUMMARY OF THE INVENTION

One object of the present invention is to facilitate easy manufacture and assembly of heat exchangers incorporating matrices of such superplastically formed/diffusion bonded heat exchanger plate elements.

According to the present invention, a plate-fin type of heat exchanger for facilitating exchange of heat between at least two process streams, comprises;

a matrix of heat exchange plate elements arranged in side-by-side spaced apart relationship, metal jacket means enclosing the matrix of heat exchange plate elements, process stream inlet and outlet manifold means for passing the process streams through the metal jacket to and from the matrix of heat exchange plate elements, a first plurality of flow passage means for at least a first process stream, the first plurality of flow passage means being defined between adjacent plate elements;

heat exchange flow passage means within the plate elements for at least a second process stream, and inlet and outlet means at edge locations of the plate elements, the inlet and outlet means being connected to the heat exchange flow passage means and to the inlet and outlet manifold means for flow of at least the second process stream therethrough.

Preferably, the plate elements comprise diffusion bonded stacks of metal sheets having a superplastically expanded internal core structure defining heat exchange flow passage means for at least the second process stream.

Preferably, the plate elements have edge portions which are thin relative to portions of the plate elements having the expanded internal core structure, adjacent plate elements being held in position in the matrix relative to each other by serrated bar means which engage the thin edge portions of the plate elements.

Preferably, at least the inlet manifold means for at least the second process stream is detachable from the metal jacket means, the heat exchanger matrix being removable from the metal jacket means together with the inlet manifold means.

The invention further provides a plate-fin type of heat exchanger for facilitating exchange of heat between at least two process streams, the heat exchanger comprising a matrix of heat exchange plate elements arranged in side-by-side spaced apart relationship, flow passage means for at least a first process stream being defined between adjacent plate elements, the plate elements being a sandwich construction comprising two outer sheets and an expanded core sheet structure between the two outer sheets, the sandwich construction providing flow passage means for at least a second process stream, adjacent plate elements being held in position relative to each other by serrated tie bar means which engage the edges of the plate elements.

In a further aspect, the invention provides an inlet or outlet manifold assembly for at least the second process stream in the above-mentioned heat exchangers, comprising;

projecting edge portions of the plate elements which define slot-shaped inlet or outlet means for flow of at least the second process stream through the plate elements, and a manifold with wall means having slots therethrough, the projecting edge portions of the plate elements being secured in the slots such that process stream flow can occur between the manifold and the interior of the plate elements.

BRIEF DESCRIPTION OF THE DRAWINGS

An exemplary embodiment of the present invention will now be described with reference to the accompanying drawings, in which.

DETAILED DESCRIPTION OF THE INVENTION

Superplastic forming and diffusion bonding are well known metallurgical phenomena.

Superplasticity is a deformation phenomenon which allows some materials to strain by large amounts without the initiating of tensile instability or necking. This enables the generation of high volume fractions of hollowness in a heat exchanger matrix, while allowing designs of good mechanical and thermal performance, together with low weight and high utilisation of material.

Diffusion bonding is a metal interface phenomenon in which, provided clean metal surfaces at a suitable temperature are protected from surface contamination by the provision of a suitable joint face environment, and sufficient pressure is applied to the mating surfaces, then solid state diffusion of the metal atoms across the boundary takes place to such an extent that subsequently no interface can be detected. No macroscopic deformation takes place during bonding and therefore shape and size stability is maintained during the operation. Furthermore, the joint produced has parent metal properties without the presence of a heat affected zone or other material such as a flux or bond promoter. Its use within a heat exchanger therefore reduces the possibility of chemical interaction with process fluids.

The heat exchanger plate elements shown in FIGS. 2 to 5 are manufactured by a superplastic forming/diffusion bonding process which will first be briefly described in a simplified manner with reference to FIG. 1. For fuller details of manufacture, reference should be made to our earlier patent applications EP90308923.3 and GB9012618.6.

Figure 1A:
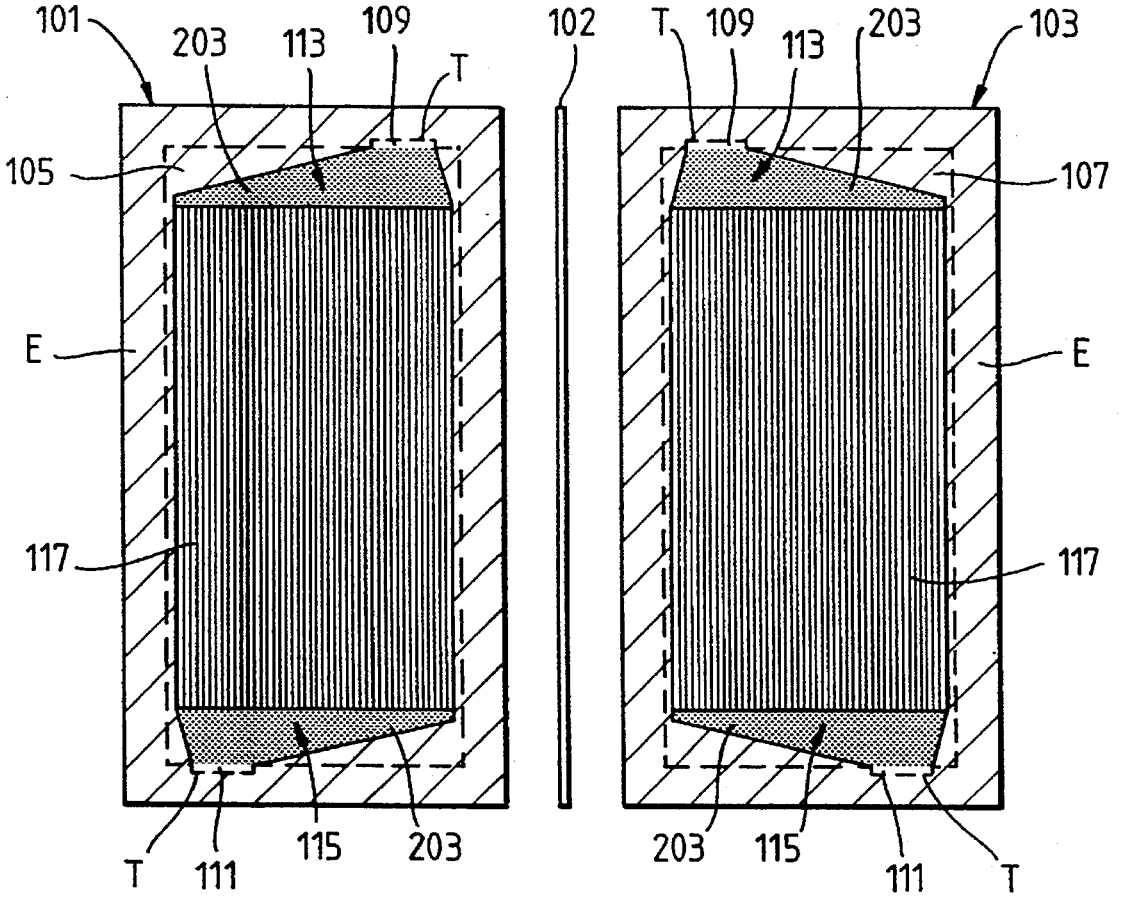
FIGS. 1A to 1C illustrate a process for manufacturing a heat exchanger plate element suitable for use in the present invention.

Referring to FIG. 1A, three superplastically formable metal sheets 101,102,103 (made of, for example, a suitable titanium alloy), of near net shape and controlled surface finish, are cleaned to a high standard and a bond inhibitor is deposited onto selected areas (shown as white) of the joint faces 105,107 of the two outer sheets 101,103. Bare metal areas are shown hatched, or as lines or dots. The deposit specifies the ultimate internal configuration of the finished heat exchanger plate element, and comprises areas defining process stream inlets 109 and outlets 111, inlet and outlet flow distributor regions 113 and 115 respectively, and flow passages 117 within the element. Edge regions E of the sheets 101,103, where it is not desired to produce an internal structure, do not have any bond inhibitor applied.

Although the internal geometry is fixed at this stage, the deposition process, e.g. silk screen printing, allows considerable flexibility of design to satisfy both mechanical and thermal requirements.

Figure 1B:
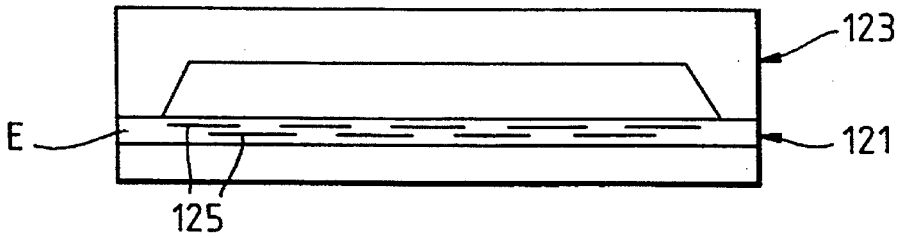
Figure 1C:
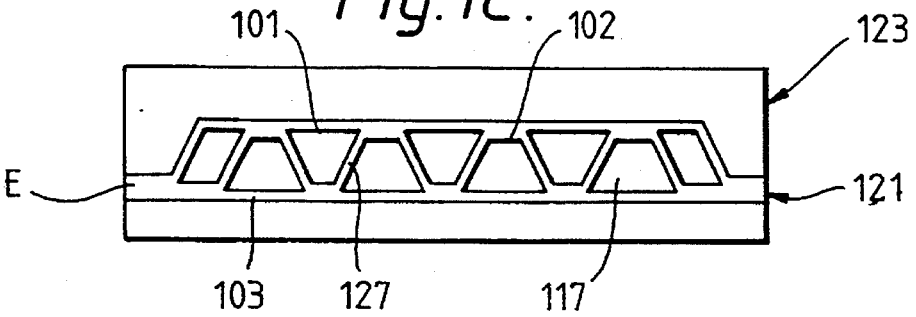

The sheets 101,102,103 are then stacked and diffusion bonded together in the manner detailed in our earlier patent applications, resulting in a bonded stack 121, which is placed in a closed die 123 as shown schematically in cross-section in FIG. 1B. Superplastic forming of the bonded stack 121 into almost the final shape of the heat exchanger plate element, complete with its internal structure as shown schematically in FIG. 1C, now occurs. The bonded stack 121 and the die 123 are heated to superplastic forming temperature and the stack's interior structure, as defined by the pattern of bond inhibitor 125, is injected with inert gas at high pressure to inflate the stack so that the outer sheets 101,103 move apart against the die forms. As the cuter sheet 101 expands superplastically into the die cavity, it pulls the middle or core sheet 102 with it where diffusion bonding has occurred. Superplastic deformation of the core sheet 102 therefore also occurs to form a hollow interior which is partitioned by the stretched portions 127 of the core sheet 102, thereby creating passages 117 through which a process stream can flow. The edge regions E of the stack 121 remain fully bonded, and therefore flat and unexpanded.

It is convenient for manufacturing purposes if all the sheets 101,102,103 are made of superplasticatly formable titanium alloy, or other superplastically formable metallic material, though only the sheets 101 and 102 are in fact superplastically deformed during manufacture of the element.

After the superplastic forming process has been finished, each article so produced is trimmed around its edges, along the dashed line indicated in FIG. 1A. This creates openings into those parts of the expanded internal structure which define the inlet 109 and outlet 111, these being revealed as expanded rectangular slots in otherwise thin edges of the articles. The line of the trimming is such as to leave projecting edge portions or tangs T on the outer sheets 101,103 at opposed edges of the formed article. These tangs T define the openings to the inlet slot 109 and the outlet slot 111. After trimming, the inlet slot 109 and the outlet slot 111 are, for the purposes of the present embodiment, completely opened up internally for flow of a single stream of the process fluid by an internal milling or routing operation to cut away obscuring portions of the core sheet 102. This produces the heat exchanger plate element 200 as further illustrated in FIGS. 2 and 3, which is ready for incorporation in a matrix of such elements.

The superplastic forming/diffusion bonding process outlined above results in the production of very accurately formed external surfaces for sheets 101,103, which enable good conformance of each heat exchanger element to its neighbours in a matrix of such elements.

Figure 2:
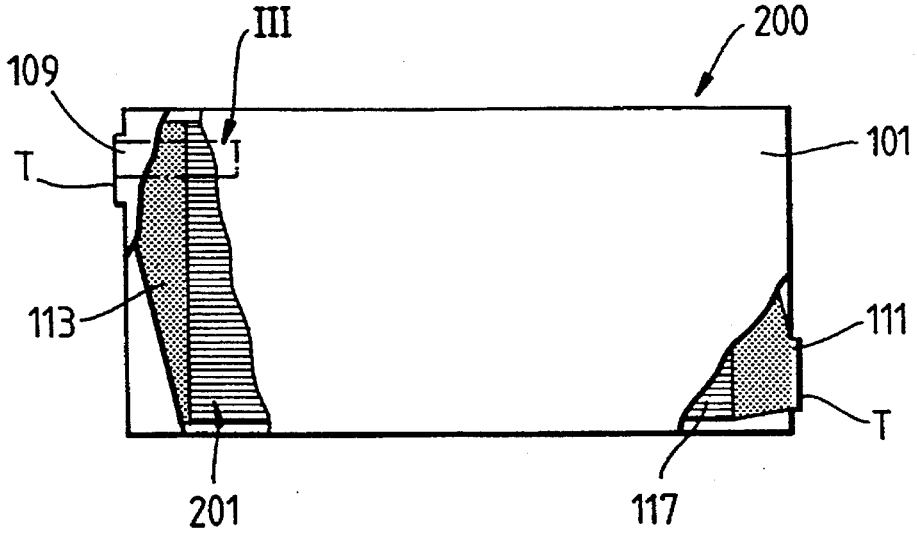
FIG. 2 is a plan view of a heat exchanger plate element suitable for use in the present invention, part of its top face being removed to show its interior structure.
Figure 3:
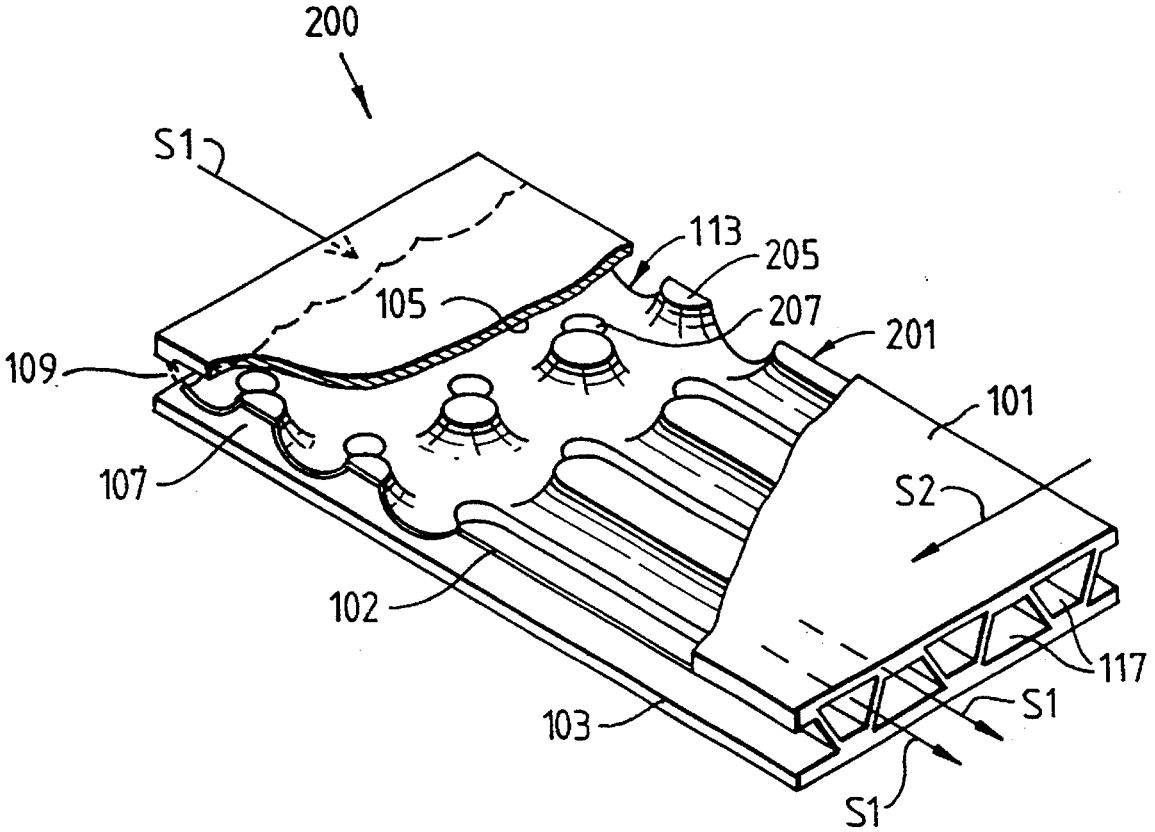
FIG. 3 is an enlarged perspective detail view of that part of the heat exchanger plate element in FIG. 2 which is indicated by arrow III.

Referring now to FIGS. 2 and 3, the heat exchanger plate element 200 illustrated has a core structure 201 comprising the single core sheet 102. Looking at the features of the heat exchanger plate element 200 in the order in which they would be encountered by a stream of process fluid passing through it, the inlet 109 is merely a gap between sheets 101 and 103 where the core sheet 102 has been cut away by the above-mentioned routing or milling operation to the extent shown by the dotted lines. This allows the process fluid to flow on both sides of the core sheet 102 and hence, after traversing the inlet distributor region 113, into all the passages 117 formed alternately between the core sheet 102 and the outer sheets 101,103.

The inlet 109 opens directly into the inlet flow distributor region 113, which is a region where the bond inhibitor was not applied to numerous small circular areas or dots 203 on both the joint faces 105,107 of the outer sheets, see FIG. 1A. These dots 203 are arranged in rows as shown, with each dot on a given joint face 105 being positioned midway between each group of four dots on the other joint face 107. Of course, other dot patterns may be used at the discretion of the designer. At these dots 203 the core sheet 102 is diffusion bonded to the outer sheets 101,103 and during the superplastic forming operation the core sheet 102 is expanded to the double cusped configuration shown in FIG. 3.

The upstanding peaks 205 and depressions 207 thus formed on both sides of the core sheet 102 in the distributor region 113 act to diffuse the flow of the process stream so that by the time it has traversed the inlet distributor 113 it is distributed over the entire transverse extent of the core structure 201 and enters all the passages 117.

The major part of the core structure 201 consists simply of straight line corrugations formed in the core sheet 102. These corrugations are of such a form that, in conjunction with the outer sheets 101,103, longitudinally straight flow passages 117 with a trapezoid shaped cross-section are defined. As shown in FIG. 3, the transition between the so-called "dot core" distributor regions 113 and the "line core" passage region is easily arranged.

In the present embodiment, the core structure 201 consists of a single sheet 102, though it could consist of more than one sheet if a more complex core structure 201 is required, as shown in our copending patent application EP90308923.3.

The present embodiment is concerned with a simple heat exchanger plate element in which one process stream S1 flows through it on both sides of the core sheet 102 and therefore through all the passages 117 in the core structure. Another process stream S2, with which process stream S1 exchanges heat, flows over the outside surfaces of the heat exchanger plate element 200. Consequently, the primary heat exchange surfaces are the surfaces of the outer sheets 101,103, whereas the secondary heat exchange surfaces, designated "fins", are the surfaces of the core sheet 102 forming the partitions between the flow passages 117.

Whereas the flow directions for the process streams S1 and S2 are at right angles to each other, a condition known as cross-flow, the design could of course be altered to make stream S2 flow in any direction across the heat exchanger elements.

The person skilled in heat exchanger technology will realise that it would be easy to arrange the inlets, outlets and the core structure 201 of the element 200 so as to accommodate two process streams, one on each side of the core sheet 102, so that neighbouring flow passages 117 would carry different streams exchanging heat directly across the partitions between the passages.

It should be realised that the simple geometries shown for the core sheet 102 in the present drawings could readily be altered to produce more conventional finning arrangements, such as herringbone, serrated and perforated, as known in the industry.

Furthermore, for increased efficiency of heat exchange, it may be desirable to dispense with separate passages 117 formed by corrugations in the core sheet 102. Instead, the core sheet could be formed into the cusped configuration of the distributor regions 113,115 throughout its whole extent.

Figure 4:
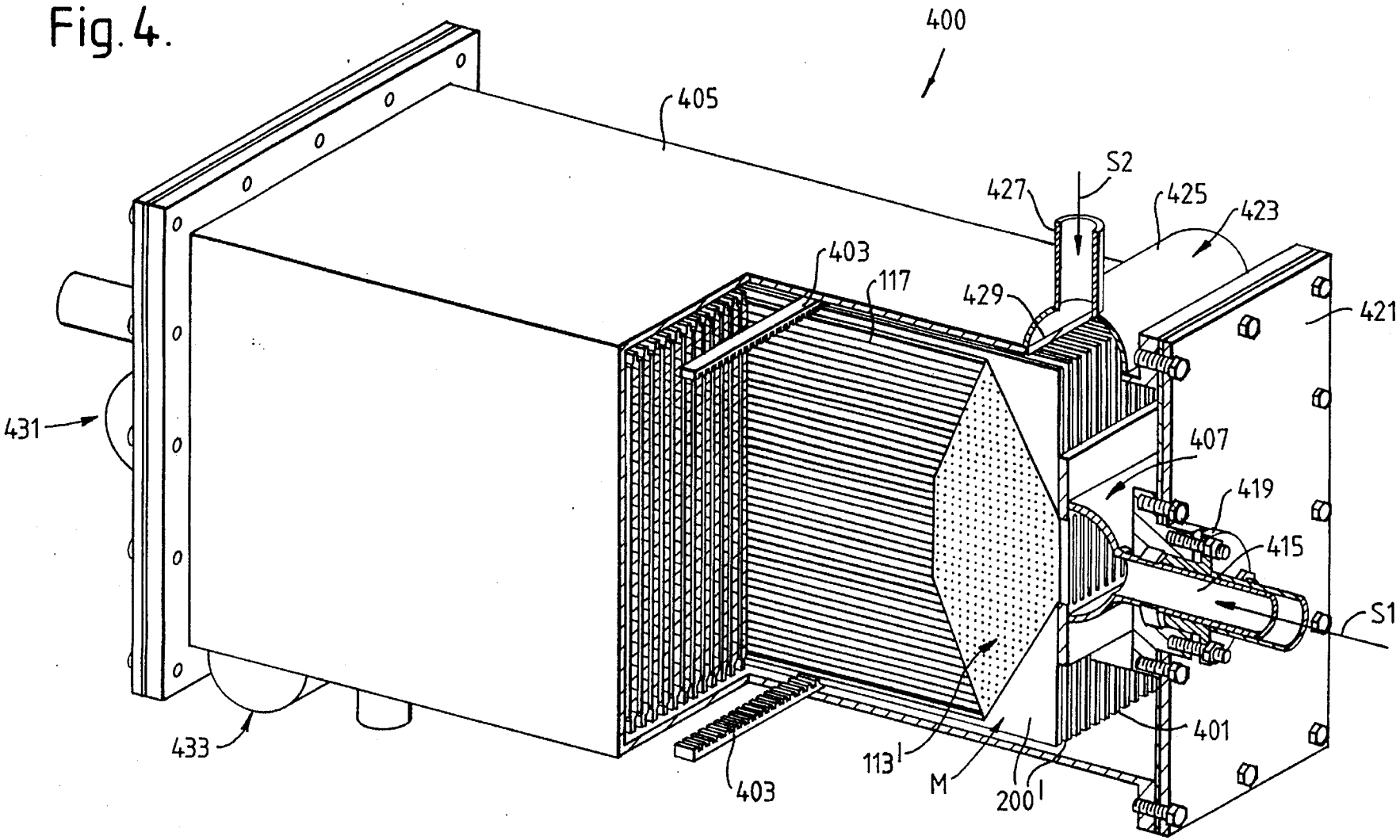
FIG. 4 is a part-sectional view of a complete heat exchanger according to the invention.
Figure 5:
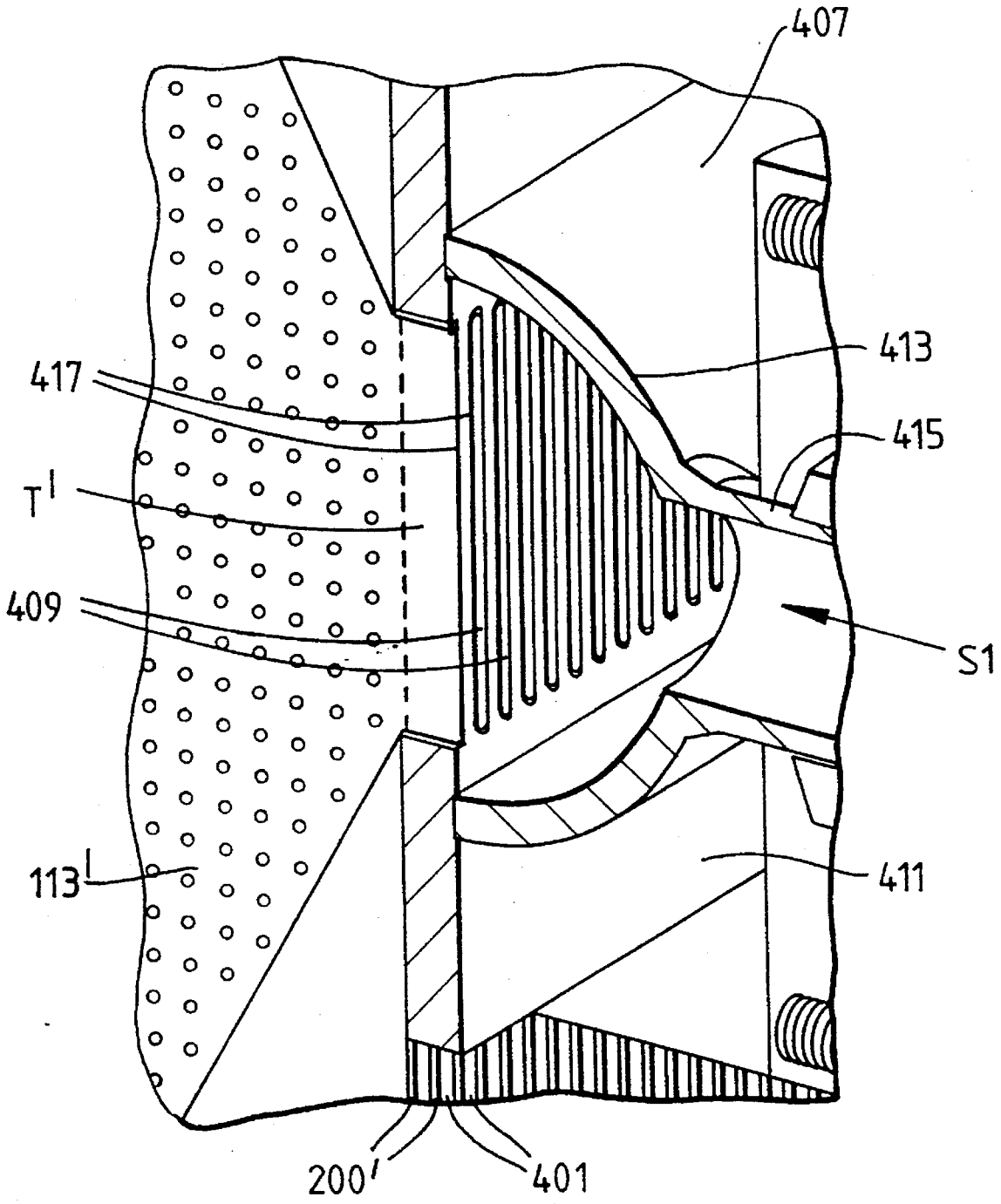
FIG. 5 is an enlarged view of part of FIG. 4.

FIGS. 4 and 5 show how a large number of heat exchanger plate elements 200' can be assembled into a matrix M to form a complete heat exchanger 400. Heat exchanger elements 200' are similar to elements 200, except that their distributor regions 113' are arranged symmetrically about their longitudinal centrelines.

As one example of specific use for this design, the high-integrity superplastically formed and diffusion bonded plate elements 200' may be used to carry a high pressure methane stream S1 in internal passages 117', while seawater for cooling purposes may comprise the other stream S2, which flows through passages 401 between adjacent elements 200'. The individual elements 200' in the matrix M are held separated from each other and in their correct positions by toothed tie-bars or racks 403 which engage the thin, flat, unexpanded parts of the elements on their opposed edges.

After the edges of the elements 200' and the racks 403 have been correctly secured together, e.g. by means of screws or shrink-fit dowels passing through the racks 403 into the edges of the elements, or by tack-welding, the completed matrix is then inserted into a fabricated steel jacket 405. As shown in more detail in FIG. 5, the gas header or inlet manifold tank 407 is formed by inserting the edge tangs T' (similar to FIG. 2) of the outer sheets of the elements 200' into slots 409 in a flat plate 411 to which a cast half-cylindrical component 413, with integral inlet stub pipe 415, is welded. The header tank 407 is completed by semicircular end plates (not shown). The ends of the tangs T' are welded directly to the edges of the slots 409 to form weld beads 417 which outline the slots.

Returning to FIG. 4, it will be noticed that the inlet pipe 415 which feeds the gas header tank 407 passes through a gland box assembly 419 which is bolted to an end plate 421 of the steel jacket 405. This is similar to the well-known "floating head" arrangement used in shell and tube heat exchangers, and in conjunction with the way in which the end plate 421 is bolted to the rest of the steel jacket 405, enables easy removal of the entire heat exchanger matrix from the jacket 405.

Similarly, a sea water header or inlet manifold tank 423 is formed simply by welding the half-cylindrical component 425, with integral inlet stub pipe 427, over a rectangular cut-out 429 in the top surface of the jacket. Water is thus-fed directly to the passages 401 between the elements 200' of the heat exchanger matrix M.

The constructions of the gas and water outlet manifolds 431 and 433 are not shown in detail, but are similar to the constructions of the gas and water inlet headers just described.

In order to achieve the required flow distribution of water in the passages 401 between the elements 200', suitable flow distributing features, such as dimples, grooves, protrusions or fins may be provided if necessary on the outer surfaces of the elements 200'. These may be formed during the superplastic forming phase of the element manufacture by corresponding shapes on the superplastic forming dies. Alternatively, chemical etching may be used to produce such features, or baffles may be welded to the surfaces.

Some significant advantages accruing from use of the invention in design of heat exchangers are as follows.

(a) The heat exchanger matrix is readily removable from the jacket to facilitate maintenance, and individual heat exchange elements are also removable from the matrix.

(b) The process streams may be at either high pressure or low pressure without affecting the design of the heat exchange element structures.

(c) The heat exchanger is suitable for a wide range of process duties.

(d) The heat exchange passages for the streams may be of any reasonable degree of complexity without unduly increasing manufacturing costs, because extra components are not required to be assembled and fixed into position.

We claim:

1. A heat exchanger for facilitating exchange of heat between at least first and second process streams, comprising a matrix of heat exchange elements arranged in side-by-side spaced apart relationship, metal jacket means enclosing the matrix of heat exchange elements, first and second process stream inlet and outlet manifolds for passing the process streams through the metal jacket to and from the matrix of heat exchange elements, a first set of flow passages for the first process stream, the first set of flow passages being defined between adjacent heat exchange elements, a second set of flow passages within the heat exchange elements for the second process stream, and each heat exchange element having edge locations and at said edge locations of each heat exchange element, an inlet passage and an outlet passage for the second process stream being provided, the inlet and outlet passages being connected to the second set of flow passages and to the corresponding inlet and outlet manifolds for flow of the second process stream therethrough;

wherein each heat exchange element comprises a diffusion bonded stack of metal sheets having a superplastically expanded internal core structure defining the second set of flow passages for the second process stream;

said inlet and outlet manifolds for at least the second process stream comprising:

plate elements having projecting edge portions which define slot-shaped inlet and outlet means for flow of at least the second process stream through said plate elements, and a manifold with wall means having slots therethrough, the projecting edge portions of the plate elements being secured in said slots such that the process stream flow can occur between said manifold with wall means and the interior of said plate elements.

2. A heat exchanger for facilitating exchange of heat between process streams, comprising a matrix of heat exchange elements, process stream inlet and outlet manifolds for passing the process streams to and from the matrix of heat exchange elements each having edge locations, at said edge locations of each heat exchange element, an inlet passage and an outlet passage for allowing a process stream to flow through the heat exchange element, the inlet and outlet passages being connected to corresponding inlet and outlet manifolds for flow of the process stream therethrough;

wherein each heat exchange element comprises a diffusion bonded stack of metal sheets having a pair of outer sheets and a superplastically expanded internal core structure between the outer sheets, the core structure defining flow passages for the process stream and each inlet and outlet passage comprising a gap between the outer sheets where a portion of the core structure is absent;

said inlet and outlet manifolds for at least the second process stream comprising:

plate elements having projecting edge portions which define slot-shaped inlet and outlet means for flow of at least the second process stream through said plate elements, and a manifold with wall means having slots therethrough, the projecting edge portions of the plate elements being secured in said slots such that the process stream flow can occur between said manifold with wall means and the interior of said plate elements.

3. A heater exchanger according to claim 1 or 2, in which the plate elements have edge portions which are thin relative to portions of the plate elements having the expanded internal core structure, adjacent plate elements being held in position in the matrix relative to each other by serrated bar means which engage the thin edge portions of the plate elements.

4. A heat exchanger according to any preceding claims 1 or 2, in which at least the inlet manifold means for at least the second process stream is detachable from the metal jacket means, the heat exchanger matrix being removable from the metal jacket means together with the inlet manifold means.

* * * * *